US008192800B2

(12) United States Patent
Endregaard et al.

(10) Patent No.: US 8,192,800 B2
(45) Date of Patent: Jun. 5, 2012

(54) APPLICATION ROBOT WITH MULTIPLE APPLICATION DEVICES

(75) Inventors: Einar Endregaard, Rochester, MI (US); Frank Herre, Oberriexingen (DE)

(73) Assignee: Durr Systems, Inc., Auburn Hills, MI (US)

( * ) Notice: Subject to any disclaimer, the term of this patent is extended or adjusted under 35 U.S.C. 154(b) by 0 days.

(21) Appl. No.: 12/829,780

(22) Filed: Jul. 2, 2010

(65) Prior Publication Data

US 2010/0330292 A1 Dec. 30, 2010

Related U.S. Application Data

(62) Division of application No. 11/451,034, filed on Jun. 12, 2006, now Pat. No. 7,762,207.

(30) Foreign Application Priority Data

Jun. 13, 2005 (DE) ..... 10 2005 027 236

(51) Int. Cl.
*B05D 1/02* (2006.01)

(52) U.S. Cl. ..... 427/427.2; 427/421.1; 427/427.1; 427/427.3; 118/321; 118/323

(58) Field of Classification Search ..... 427/421.1, 427/427.1, 427.2, 427.3; 118/321, 323
See application file for complete search history.

(56) References Cited

U.S. PATENT DOCUMENTS

| | | | | |
|---|---|---|---|---|
| 4,042,734 | A | 8/1977 | Wiggins | |
| 4,341,821 | A * | 7/1982 | Toda et al. | 427/299 |
| 5,192,387 | A | 3/1993 | Buckley | |
| 5,240,745 | A * | 8/1993 | Yamamoto et al. | 427/236 |
| 5,320,283 | A | 6/1994 | Hollstein et al. | |
| 6,309,464 | B1 * | 10/2001 | Anfindsen | 118/668 |
| 6,817,553 | B2 | 11/2004 | Steur | |
| 2002/0071916 | A1 * | 6/2002 | Rawlings | 427/421 |
| 2002/0192357 | A1 * | 12/2002 | Dion | 427/8 |
| 2004/0159724 | A1 | 8/2004 | van der Steur | |

FOREIGN PATENT DOCUMENTS

| | | | |
|---|---|---|---|
| DE | 2218756 | A1 | 11/1972 |
| DE | 2805072 | A1 | 10/1978 |
| DE | 8805181.1 | | 7/1988 |
| DE | 69403485 | T2 | 2/1998 |
| DE | 19726349 | A1 | 1/1999 |
| DE | 19852079 | A1 | 5/2000 |
| DE | 10149424 | A1 | 4/2002 |
| DE | 10297271 | T5 | 1/2005 |
| EP | 0508130 | A1 | 10/1992 |
| EP | 0529851 | A1 | 3/1993 |
| EP | 0579417 | A1 | 1/1994 |
| EP | 0642840 | A1 | 3/1995 |

(Continued)

OTHER PUBLICATIONS

Office Action from German Patent Office dated Dec. 27, 2005.
U.S. Office Action dated Nov. 6, 2009 from parent application.
Wikipedia Article Måander (Ornamentik); http://de.wikipedia.org/wiki/M%C%A4ander_(Ornamentik) Aug. 25, 2010—w/English Abstract.

*Primary Examiner* — Timothy Meeks
*Assistant Examiner* — Nathan T Leong
(74) *Attorney, Agent, or Firm* — Rader Fishman Grauer

(57) ABSTRACT

An application robot, specifically a painting robot, for coating workpieces with a coating medium and an appropriate operating method. The painting robot has multiple movable axes and a spatially positionable end effector. Multiple application devices are attached to the end effector.

14 Claims, 10 Drawing Sheets

FOREIGN PATENT DOCUMENTS

| | | | |
|---|---|---|---|
| GB | 2190312 | A | 11/1987 |
| JP | 2000005659 | A | 1/2000 |
| WO | WO-0187497 | A1 | 11/2001 |
| WO | WO-2004/085082 | A1 | 10/2004 |

* cited by examiner

APPLICATION ROBOT WITH MULTIPLE APPLICATION DEVICES

CROSS-REFERENCES TO RELATED APPLICATIONS

The present application is a divisional of U.S. patent application Ser. No. 11/451,034, filed Jun. 12, 2006, and claims priority from German Patent Application Serial No. 10 2005 027 236.3, filed Jun. 13, 2005, the entire contents of both applications being incorporated herein by reference.

TECHNICAL FIELD

The invention relates to an application robot, specifically a painting robot, and an appropriate operating method.

BACKGROUND

It has long been the practice to use multi-axis painting robots with a highly mobile, multi-axis robot wrist to paint workpieces, such as automobile body parts. In these robots, a single rotational atomizer is attached to the robot wrist and applies the desired paint.

BRIEF SUMMARY OF THE INVENTION

Embodiments of the invention include the broad teaching of mounting not just a single application device but several application devices on the end effector of an application robot. This offers the advantage that the surface covering ability of the application robot is substantially increased compared with known robots.

The term application robot as used herein includes not only the rotational atomizer preferably used and cited initially but also other types of application devices, such as spray guns, 2K atomizers or other atomizers. The invention is particularly suitable for an application robot that applies fluid paint, but the invention can also be implemented with application robots that apply powder paint, high-viscosity material, underbody protection, PVC or the like.

The application robot can be a conventional, multi-axis robot with, for example, six or seven movable axes. However, the invention is not restricted to 6- or 7-axis application robots but can be implemented with other types of robots. The application devices of the application robot can be positioned next to each other at a specified distance and discharge a spray with a specified spray width in the same direction.

In a variant of the invention, the spray width is at least as large as the distance between the application devices so that the spray paths from the adjacent application devices overlap. In this way a cohesive area on the surface of the workpiece is coated in a single working stroke.

Alternately, the width of the spray is smaller than the distance between the application devices so that the spray paths from the adjacent application devices do not overlap. In this instance, parallel paths of the coating medium are applied on the surface of the workpiece in one stroke so that a cohesive coating on the workpiece requires several working strokes made offset to one another. In this case it is possible to select the width of the spray and the distance of the application device such that a surface can be coated with a specific width without lifting or activating the coating medium valve by shifting the end effector with the attached application devices laterally between the successive, antiparallel strokes. The end effector with the attached application devices can be guided in such a way that the overlap between the coating paths created is double, triple or quadruple.

The term spray width usually refers to the width of the spray when it contacts the surface of the workpiece, but instead of spray width it is also possible to speak of spray angle, when the latter applies particularly to what is called airless atomization and the application of high-viscosity materials. However, the term spray width preferably means SB50. This is the width of the coating path within which the film thickness is more than 50% of the maximum film thickness.

In any case, according to embodiments of the invention, there is the possibility that the spray width is adjustable at least with one of the application devices. In this way, for example, the spray width can be adapted to the distance between the application device and the surface of the workpiece.

The possibility further exists within the scope of the invention that the application devices mounted on the application robot from the invention belong to different types. For example, one application device may be a water-based paint atomizer, while the other application device may be a solvent-based atomizer. The possibility also exists that one application device is used to apply water-based paint and is correspondingly externally charged, while the other application device is used to apply solvent-based paint and therefore the coating medium is directly charged. Both application devices can be directly charged, where one application device is designed to apply water-based paint, whereas the other application device applies solvent-based paint.

Furthermore, one of the application devices can be a rotational atomizer (with or without external charging), while the other application device can be an air atomizer (with or without high-voltage charging), which is suitable for special paint processes.

The possibility also exists that one of the two application devices is used to coat large surfaces, while the other application device is used to coat smaller surface. When coating an automobile body it is also possible that one application device is used to coat frame parts whereas the other application device coats the surfaces of the vehicle body.

The two application devices can also differ from each other in the coating medium used. For example, one of the two application devices can be used to apply basecoat, whereas the other application device applies clear coat. In another variant, one application device serves to apply a first coat of paint (basecoat 1), whereas the other application device applies a second coat of paint (basecoat 2). Furthermore, the application robot can also carry more than two application devices, for example, two rotational atomizers and one air atomizer.

One of the two application devices is preferably angled at 180° from the other application device. This has the advantage with alternating operation that the application device not in use becomes less, or not at all, contaminated when the adjacent application device is applying coating medium.

A further advantage is that the one application device can be purged while the other application device is applying coating medium, which usually only works when the individual application devices apply the coating medium in the same direction. In this way, the time for a color change can be reduced to zero since the individual application devices apply coating medium alternately, while a color change can be undertaken in the pauses between coating. The application robot therefore preferably has separately controllable purge lines, coating medium lines or coating medium supplies for the individual application devices. With separate metering equipment for the application devices, the individual metering devices can be driven by a common motor connected by a coupling to each of the metering devices.

It is alternatively also possible that the application devices are connected to a common coating medium supply, or a common metering pump, where the common metering pump is preferably located in the robot arm adjoining the robot wrist axis or in the subsequent robot arm.

In an advantageous variant of the invention, the individual application devices are not located at a fixed distance from one another determined by the design but are at an adjustable distance to one another. For example, the distance between the adjacent application devices can be adjusted electrically or pneumatically, although other positioning drives are possible.

In certain embodiments of the invention, the application devices are aligned parallel or antiparallel to each other, which brings specific advantages. A parallel orientation of the application devices permits simultaneous operation, whereby the surface efficiency when coating is increased. On the other hand, an antiparallel orientation of the application devices is advantageous if the application devices are operated alternately, since the inactive application device is largely protected from contamination by the active application device, as was already mentioned briefly.

It is alternatively also possible that the application devices are angled to one another at a specified angle, where the angle between the application devices can lie in the range between 10° and 180°, with any value in between being possible. For example, the angle between the application devices can be 45°, 90° or 180°, where application devices in the last instance are aligned antiparallel.

In addition, the application devices with the application robot can have an electrostatic charge of the applied coating medium. The electrostatic charge can be done by conventional external charging, for example, or similarly known direct changing.

It must be mentioned further that the invention relates not only to the previously described application robot in accordance with the invention but also its novel use to coat automobile body parts.

In addition, the invention includes an operating method for a multiaxis application robot with a spatially positionable end effector, where several application devices are carried jointly on the end effector.

In one variant, a change of coating medium is performed on one application device while a coating medium is applied with the other application device, which permits uninterrupted coating operations.

The possibility further exists that one of the application devices always applies a particular frequently used coating medium ("high runner") while the other application device applies all other possible coating media ("low runners"), which are required less often. This offers the advantage that color and purge solvent losses are reduced since no color change is needed for the frequently used coating medium.

It is furthermore advantageous if the end effector of the application robot is driven to one edge of the workpiece to be coated in order to purge the application robot to prevent contamination of the workpiece to be coated. When coating automobile body parts with a hood or trunk lid the end effector with the application devices for purging can be driven, for example, under the open hood or trunk lid.

Embodiments of the invention make possible different novel movement patterns in coating workpieces, which will be described briefly in what follows.

In one variant, the end effector of the application robot with the application devices is led along the surface of the workpiece to be coated in a prescribed pass where the end effector with the application devices is aligned essentially at right angles to the pass direction. The application devices are guided next to each other along the surface of the workpiece, where the sprays from the individual application devices either form separate paths of coating medium on the surface of the workpiece or overlap each other in the lateral direction.

An alternate possibility exists that the end effector with the application devices is aligned essentially parallel to the pass direction so that the individual application devices are guided one after the other over the surface of the workpiece. The result is that the surface of the workpiece is contacted in one working stroke by the spray from the individual application devices. This allows the pass speed of the application devices to be increased.

In addition, the workpiece to be coated (e.g., an automobile body) is preferably transported in a specified direction where the end effector with the application devices can be optionally aligned at right angles or parallel to the direction of transportation.

The end effector with the application devices can be guided multiple times over the workpiece to be coated in parallel or antiparallel work strokes, where the distance between the individual working strokes is preferably smaller than the width of the spray so that coating medium paths produced in the individual work strokes overlap on the workpiece surface.

After a prescribed number of work strokes, the end effector is then preferably advanced by a prescribed amount at right angles to the work strokes, where the distance depends on the spacing between the individual application devices.

When coating curved workpiece surfaces, the distance between the individual application devices and the workpiece surface to be coated is different with the individual application devices. This can be a problem in known robots. In embodiments of the invention, this distance can be determined and used to adjust at least one operating parameter such as shaping air, turbine speed, coating medium pressure, coating medium volume and/or spray width. The distance between the individual application devices and the surface of the workpiece can be determined simply even without a measurement since the spatial position of the end effector (TCP tool center point) is known from the path controls of the application robot while the contour of the workpiece surface to be coated is also specified.

It is further noted that the end effector with the application devices is moved forward preferably in the x-direction when coating horizontal surfaces (i.e., when coating automobile bodies in the direction of the conveyor) when the coating can be carried out without interruption and without activating the main needle.

Instead of this, the possibility also exists when coating horizontal surfaces by moving the end effector with the application devices forwards in the y-direction, i.e., perpendicular to the conveyor direction of the automobile bodies.

When coating vertical surfaces, the end effector with the application devices is preferably moved forward in the z-direction (i.e., in the vertical direction).

Other advantageous developments of the invention are identified in the dependent claims or are explained in what follows along with the description of the preferred embodiments of the invention with reference to the figures.

BRIEF DESCRIPTION OF THE DRAWING

The description herein makes reference to the accompanying drawings wherein like reference numerals refer to like parts throughout the several views, and wherein.

DETAILED DESCRIPTION

The disadvantage of these known painting robots is the unsatisfactory area coverage when coating, since a single rotational atomizer can coat only a limited workpiece area within a specific time period.

Figures 1A, 1B:
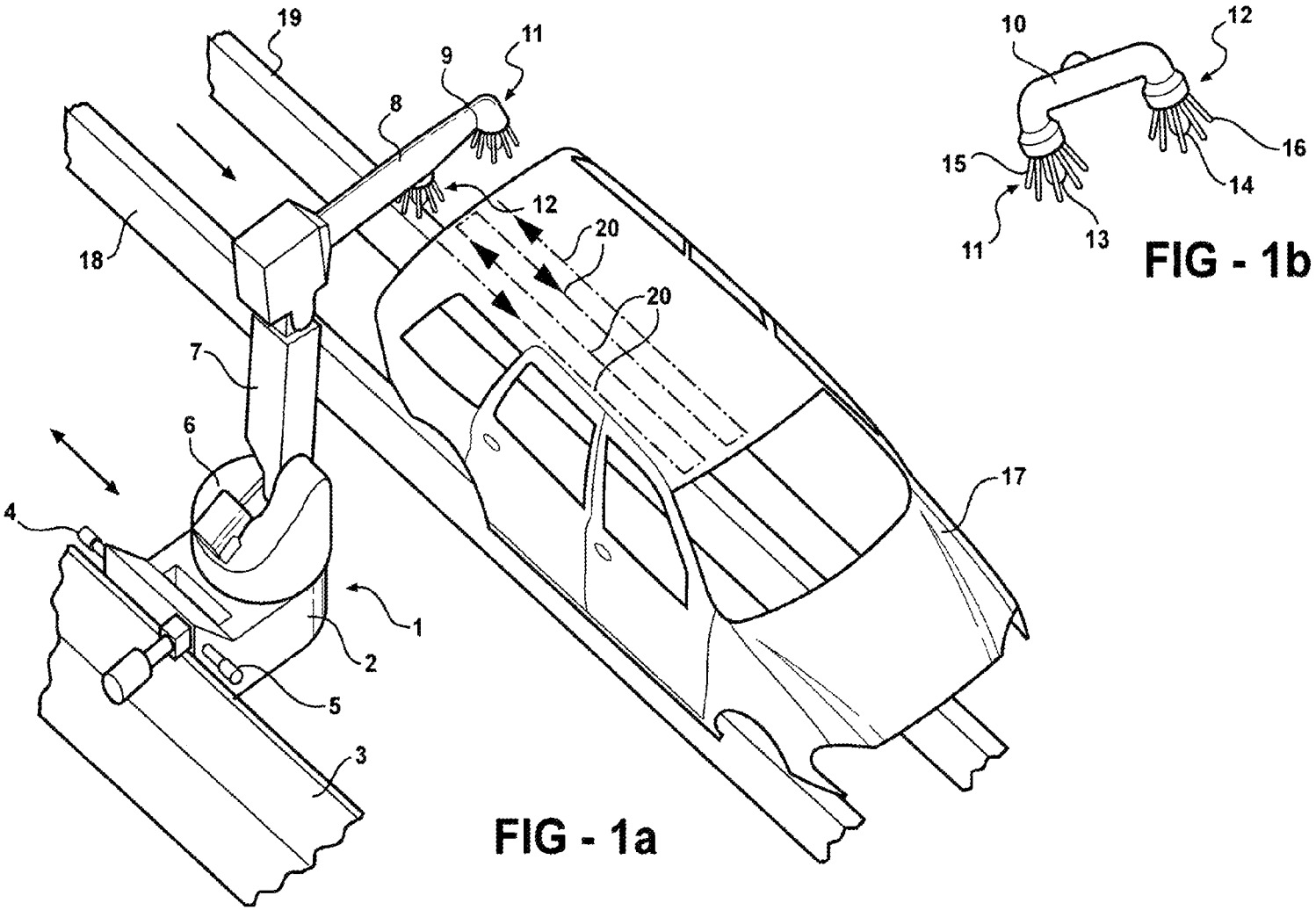
FIG. 1*a* is a perspective view of a painting robot in accordance with an embodiment of the invention having two rotational atomizers where the rotational atomizers are carried next to each by the painting robot.
FIG. 1*b* is a perspective view of the end effector of the painting robot from FIG. 1*a* with the two rotational atomizers.

FIG. 1*a* shows a perspective view of a painting robot 1 in accordance with an embodiment of the invention. The painting robot 1 has a base 2 movable in a conventional manner on a horizontal rail 3 that positions the painting robot 1 in the direction of the arrow along the rail 3. On the front side and the back side of the base 2 of the painting robot 1 there is a bumper 4, 5 to prevent damage in the event of a collision of the painting robot 1 with an adjacent painting robot or a fixed obstacle.

The painting robot 1 further has in conventional fashion a carousel 6 that can be rotated about a vertical axis and two pivotable robot arms 7, 8 and a multi-axis robot wrist 9, all of which are known.

An end effector 10 is attached at the distal end of the robot wrist 9. The end effector 10 carries two rotational atomizers 11, 12, as can be seen in particular from the detailed drawing in FIG. 1*b*.

The two rotational atomizers 11, 12 are located in parallel next to each other on the end effector 10 of the painting robot 1 and apply a spray of coating medium through a high-speed rotating bellcup 13, 14.

The two rotational atomizers 11, 12 have conventional external electrodes 15, 16, which electrostatically charge the spray of coating medium dispensed as is known.

The painting robot 1 is used to paint an automobile body 17 that is transported through a paint facility in the direction of the arrow along two rails 18, 19. The automobile body 17 is electrically grounded so that the paint electrostatically charged and applied by the rotational atomizers 11, 12 adheres better to the vehicle body 17, increasing transfer efficiency.

The two rotational atomizers 11, 12 of the painting robot 1 advantageously allow increased surface efficiency when painting the automobile body 17 in comparison to a conventional painting robot with only a single rotational atomizer.

When painting the roof of the automobile body 17 the end effector 10 with the two rotational atomizers 11, 12 is guided in working strokes 20, which run parallel to the longitudinal extent of the two rails 18, 19 and therefore parallel to the direction the automobile body 17 is being transported. But, when guiding the end effector 10 with the two rotational atomizers 11, 12, the painting robot 1 aligns the end effector 10 at right angles to the working strokes 20 so that the two rotational atomizers 11, 12 are guided side by side next to each other.

The two rotational atomizers 11, 12 have a spray width that produces paint paths on the roof of the vehicle body that lie laterally next to one another and do not overlap. The end effector 10 with the two rotational atomizers 11, 12 is advanced in the lateral direction at each end of the serpentine pattern of adjacent working strokes 20 by a predetermined amount, where the distance is approximately one third of the width of the spray paths created. This results in adequate overlap of the spray paths.

This embodiment is especially suitable for stop-and-go applications and for conveyor belts having slow conveyor speeds, as well as for painting large horizontal surfaces such as vehicle roofs.

Figures 2A, 2B:
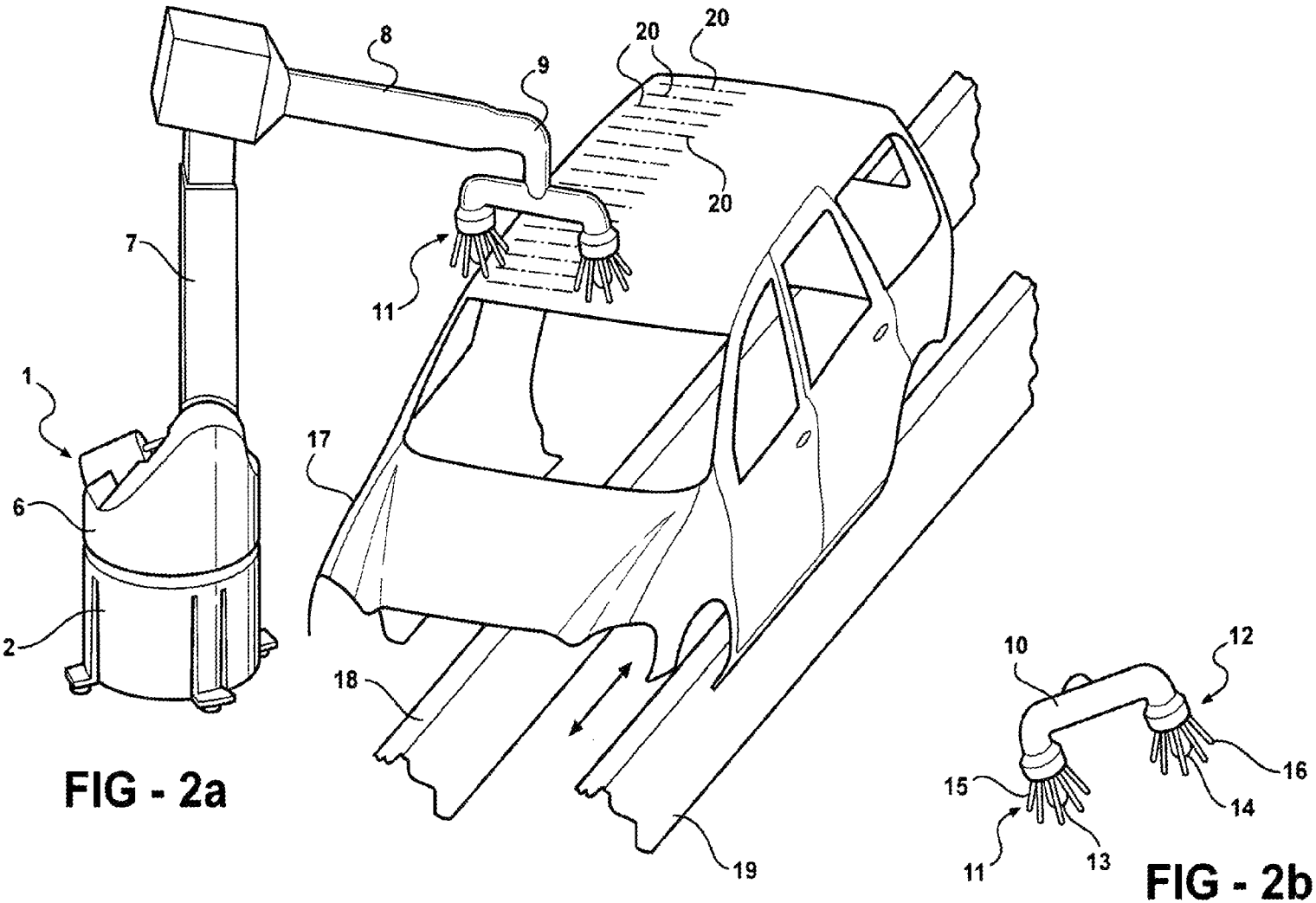
FIG. 2*a* is a perspective view of a stationary painting robot in accordance with another embodiment of the invention with two rotational atomizers that are guided one behind the other when painting.
FIG. 2*b* is a perspective view of the end effector of the painting robot from FIG. 2*a* with the two rotational atomizers.

The embodiment shown in FIGS. 2*a* and 2*b* is largely identical to the embodiment in the preceding description and shown in FIGS. 1*a* and 1*b* so that to avoid repetitions reference is made to the preceding description with the same reference numerals being used for identical components.

One variation in this embodiment is that the base 2 of the painting robot 1 is a stationary location. A further difference in this embodiment compared with the embodiment in FIGS. 1*a* and 1*b* is that the end effector 10 with the two rotational atomizers 11, 12 is guided at each of the working strokes 20 at right angles to the extension of the rails 18, 19 so that the direction of the pass in this embodiment runs at right angles to the direction of transportation.

The end effector 10 is also aligned at right angles to the direction in which the automobile body 17 is being transported.

This method of guiding the end effector 10 with the two rotational atomizers 11, 12 offers the advantage that no seventh robot axis is required. This method of guiding the end effector 10 with the two rotational atomizers 11, 12 has moreover proven to be highly effective when large horizontal surfaces have to be painted, such as for example a vehicle roof or a hood or a trunk lid.

Figures 3A, 3B:
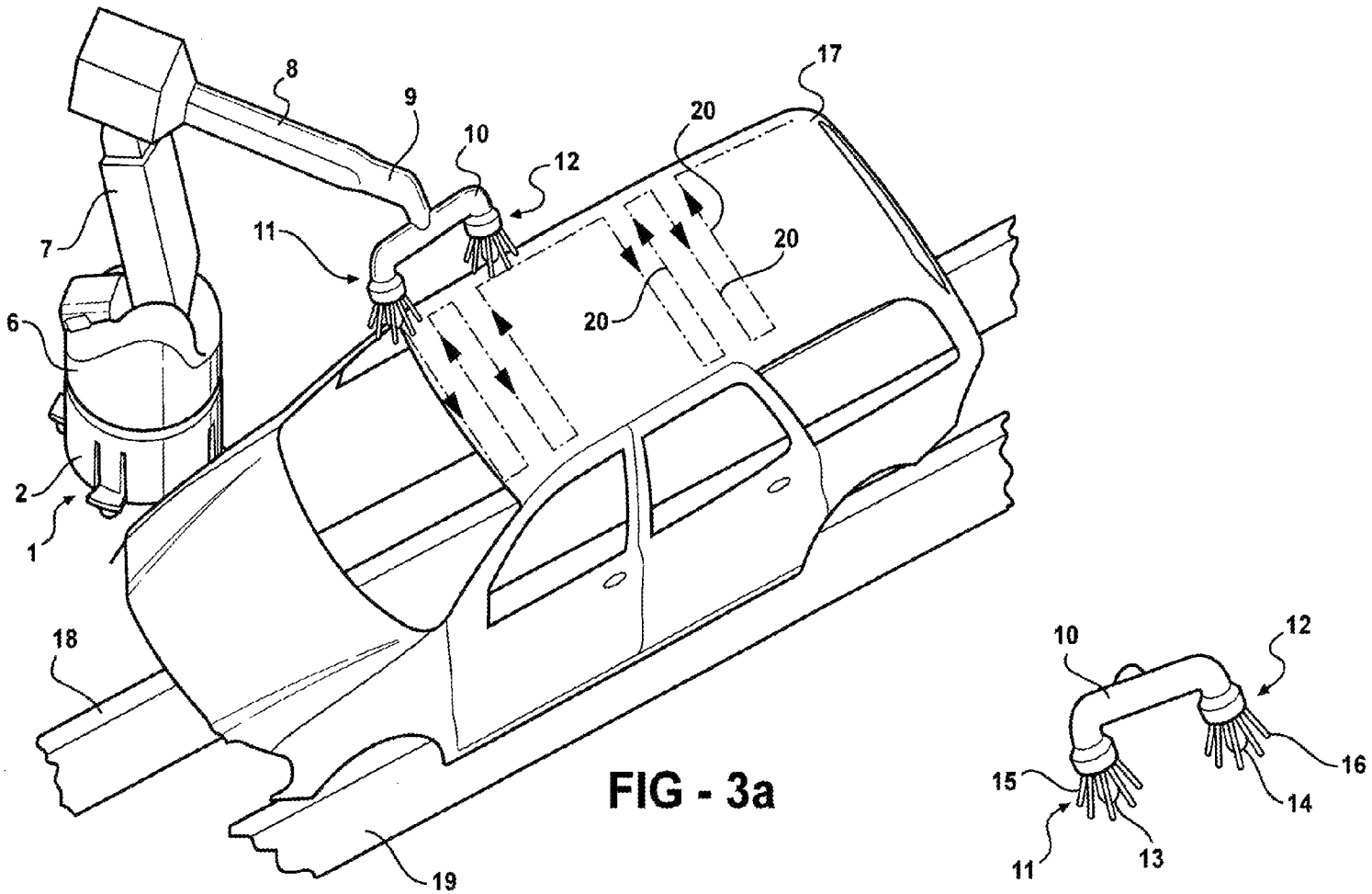
FIG. 3*a* is another embodiment of a stationary application robot with two rotational atomizers that, when coating an automobile body, are guided next to each other and perpendicular to the direction of transportation.
FIG. 3*b* is a perspective view of the end effector of the painting robot from FIG. 3*a* with the two rotational atomizers.

The embodiment shown in FIGS. 3*a* and 3*b* is also largely identical to the embodiments of the preceding description so that to avoid repetitions reference is made to the preceding description, with the same reference numerals being used for identical components.

One feature of this embodiment is that when painting the vehicle body 17, the end effector 10 with the two rotational atomizers 11, 12 is aligned parallel to the direction the vehicle body 17 is being transported. The individual working strokes 20 are aligned at right angles to the direction the vehicle body is being transported as in the embodiment from FIGS. 2*a* and 2*b*.

This embodiment also offers the advantage that the painting robot 1 does not require a seventh robot axis. This embodiment is particularly suitable for paint facilities with a conveyor path of medium speed and for stop-and-go applications. In addition, this embodiment is particularly suitable for painting large horizontal surfaces such as vehicle roofs. This embodiment is moreover suitable for painting vertical surfaces, for example, vehicle side panels.

Figure 4:
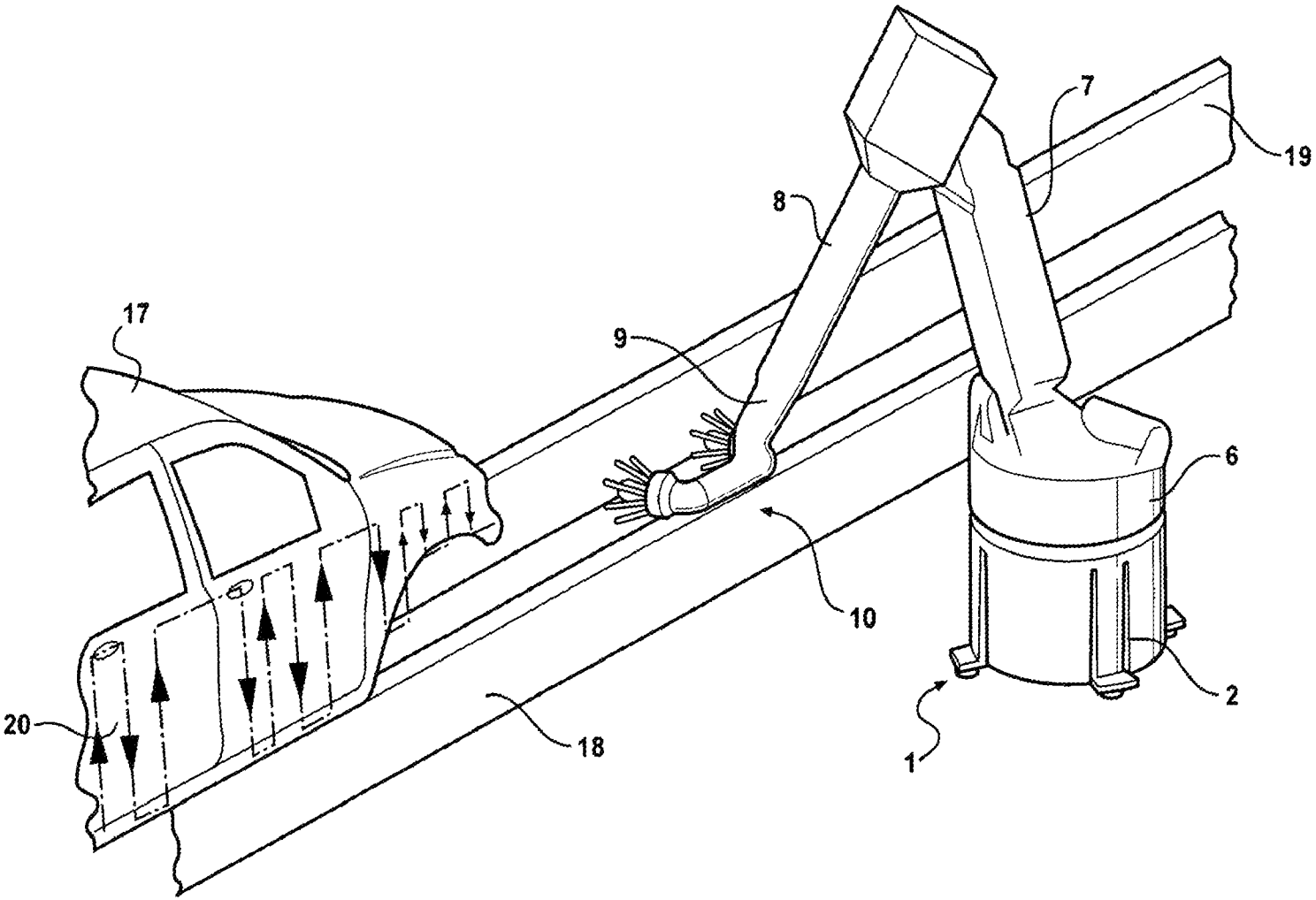
FIG. 4 is a perspective view of another embodiment of a paint robot with two rotational atomizers that are used to paint the side of automobile body parts.

FIG. 4 shows a further embodiment in accordance with the invention, which again is largely identical to the embodiments previously described. To avoid repetition reference is made to the preceding description, with the same reference numerals being used for identical components.

The base 2 of the painting robot 1 is stationary in this case as well, where the vehicle body to be painted 17 is moved past the painting robot 1 on two rails 18, 19. The painting robot 1 is particularly suitable for painting side panels of the vehicle body 17, where the end effector 10 with the two rotational atomizers 11, 12 is aligned parallel to the direction of transportation while the individual working strokes 20 are perpendicular and thus at right angles to the direction in which the vehicle body 17 is being transported.

This embodiment also does not require a seventh robot axis and is well suited for paint facilities with a fast transport path and for stop-and-go applications.

Figure 5:
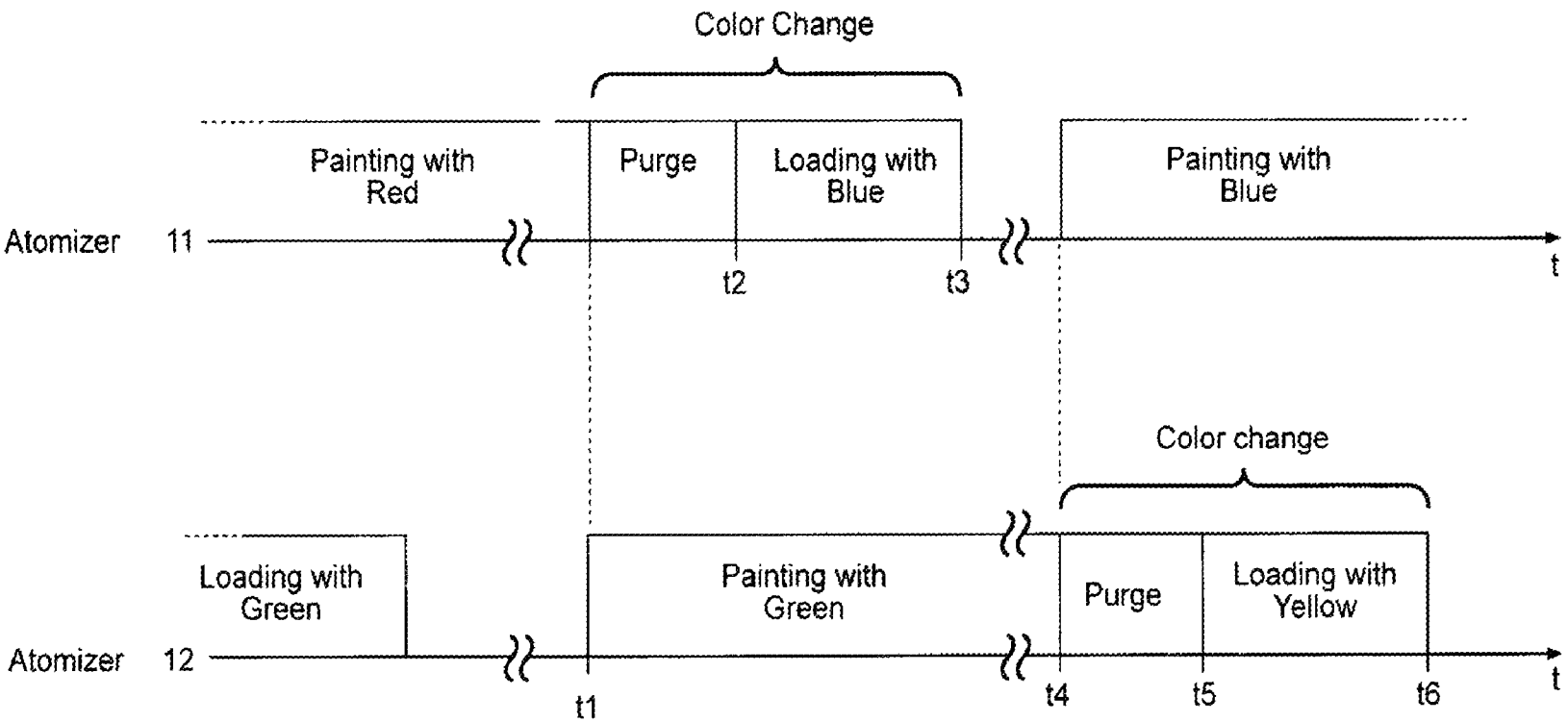
FIG. 5 is a time chart illustrating alternating operation of the two rotational atomizers.

The embodiments previously described advantageously permit interruption-free painting operation, as will be explained in what follows with reference to the time chart in FIG. 5.

Up to point in time t1 only rotational atomizer 11 is active, which in this example is applying red paint. The other atomizer 12, on the other hand, is initially inactive after atomizer 12 has been loaded with green paint and is ready to operate at any time.

At time t1 atomizer 11 finishes the painting operation, whereas rotational atomizer 12, which is ready for operation, begins to apply green paint.

After completing the painting operation at time t1, a color change takes place for rotational atomizer 11 from red to blue paint. For this, rotational atomizer 11 is first purged in the conventional way between times t1 and t2. Then the rotational atomizer 11 is loaded with blue paint between t2 and t3 so that the rotational atomizer 11 is ready for operation at time t3 to apply blue paint.

Rotational atomizer 12 performs a color change in the period between t4 and t6. For this, rotational atomizer 12 is first purged in the conventional way between t4 and t5, and then between t5 and t6 yellow paint is loaded so that rotational atomizer 12 is ready for operation at time t6 to apply yellow paint.

Paint robot 1 can apply paint interruption-free in spite of occasional color changes. Hence, surface efficiency in painting operation is clearly increased.

Figure 6:
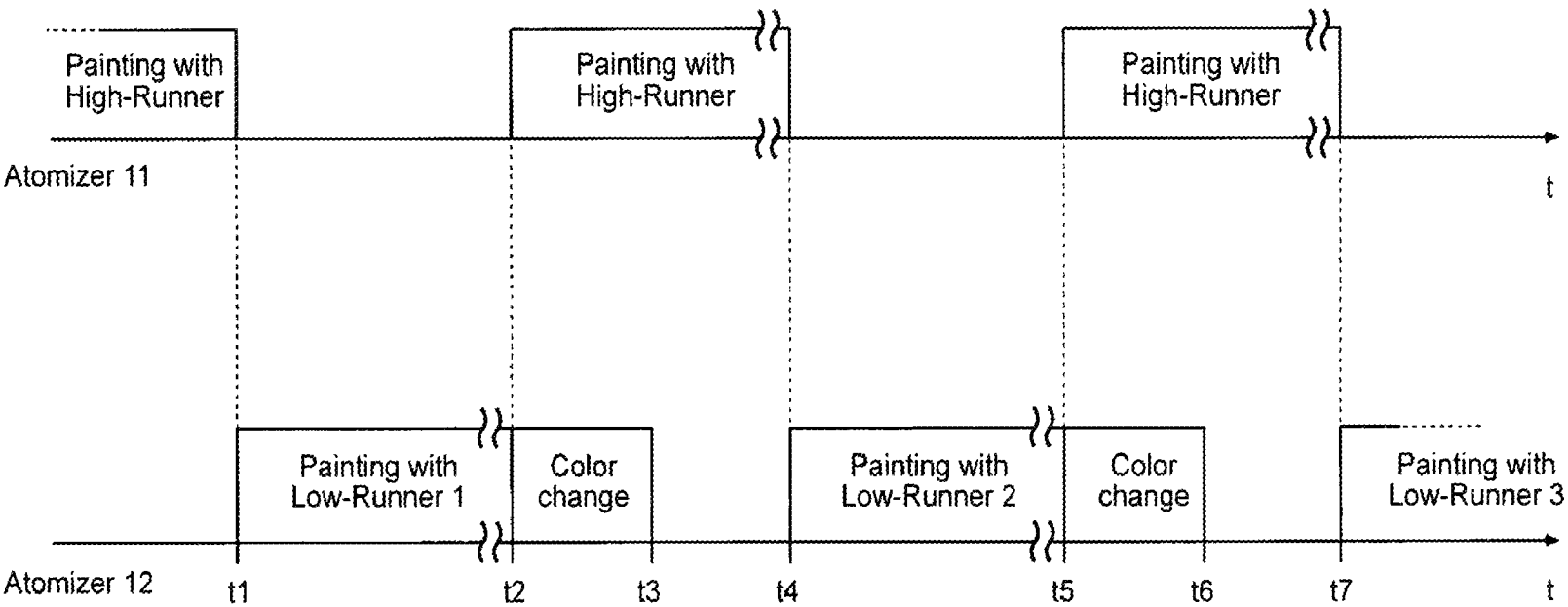
FIG. 6 is another time chart illustrating operation in an application robot with a frequently used paint and several less often used paints.

FIG. 6 shows a mode of operation of the painting robot 1 that is particularly suitable when a particular color (e.g., silver) is used frequently ("high runner") whereas the other colors ("low runners") are needed less frequently. The rotational atomizer 11 applies exclusively the frequently required paint so that the rotational atomizer 11 does not need to be purged or loaded. In this way, when painting with the frequently needed color purging solvent and paint losses are reduced. The other atomizer 12 is used on the other hand to apply the more seldom needed colors so that between times t2 and t3, and between t5 and t6, a color change is made as described previously with reference to FIG. 5.

Figure 7:
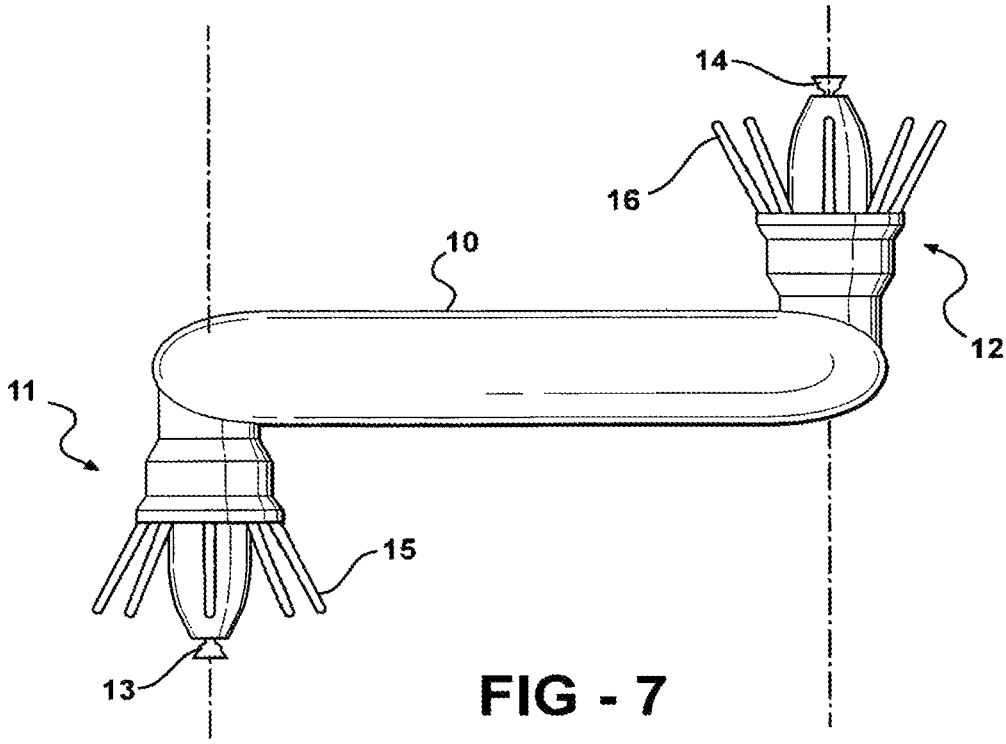
FIG. 7 is a side view of a further embodiment of an end effector with two rotational atomizers.

FIG. 7 shows an alternative embodiment of the end effector 10 that can be guided by the robot wrist axis 9 of the painting robot 1.

This embodiment of the end effector 10 differs from the previously described embodiment in that the two rotational atomizers 11, 12 are aligned antiparallel to each other. This is advantageous particularly when the two rotational atomizers 11, 12 are not operated simultaneously but alternately since the inactive rotational atomizer is kept away from the spray of the active rotational atomizer, thereby counteracting contamination of the inactive rotational atomizer.

Figure 8:
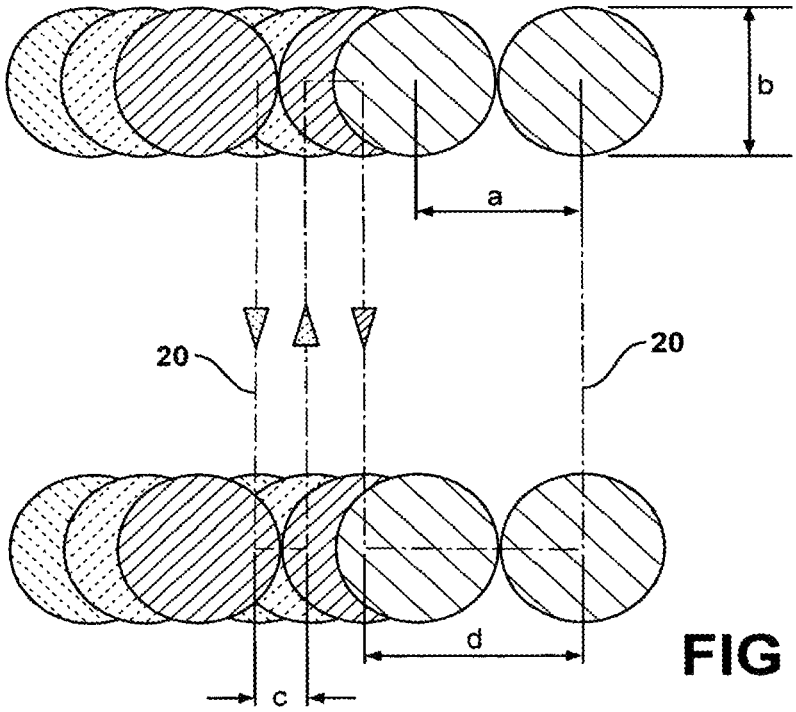
FIGS. 8 and 9 show different patterns for the movement of the application robot in accordance with embodiments of the invention when coating workpiece surfaces.

FIG. 8 shows a motion chart of the end effector 10 with the two rotational atomizers 11, 12 while painting. The end effector 10 is guided along linear working strokes 20, with the end effector 10 aligned at right angles to the working strokes 20. The two rotational atomizers 11, 12 have a spray width b on the workpiece to be coated and are located at a distance a from each other, where the spray width b is the same as the distance a between the rotational atomizers 11, 12 so that the sprays from the adjacent rotational atomizers 11, 12 abut each other directly.

Between the adjacent working strokes 20, the end effector 10 is moved forward by a specified distance c, where the distance it advances c is equal to one third of the spray width. This distance results in a corresponding overlap of the spray paths created in the individual working strokes.

After three parallel working strokes 20, the end effector 10 with the two rotational atomizers 11, 12 is then shifted laterally by a larger amount d, whereupon another three working strokes 20 are performed.

Figure 9:
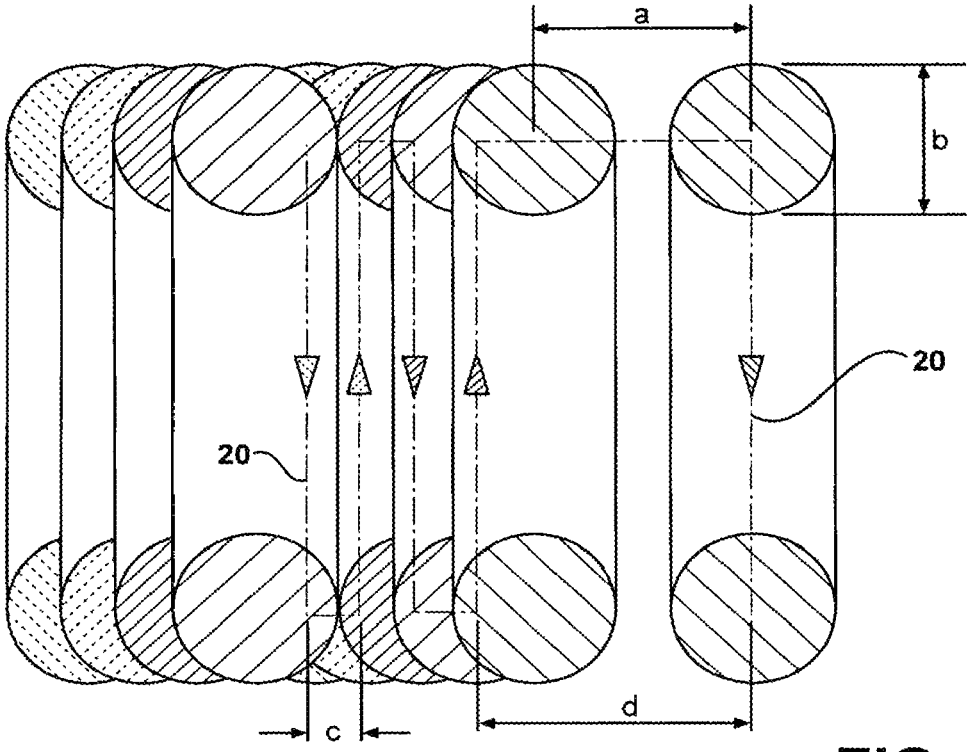

FIG. 9 shows a similar motion pattern for the end effector 10 with the two rotational atomizers 11, 12, where the distance a between the adjacent rotational atomizers is greater than width of the paint spray b so that the spray paths produced by the two rotational atomizers 11, 12 do not overlap each other.

Figure 10:
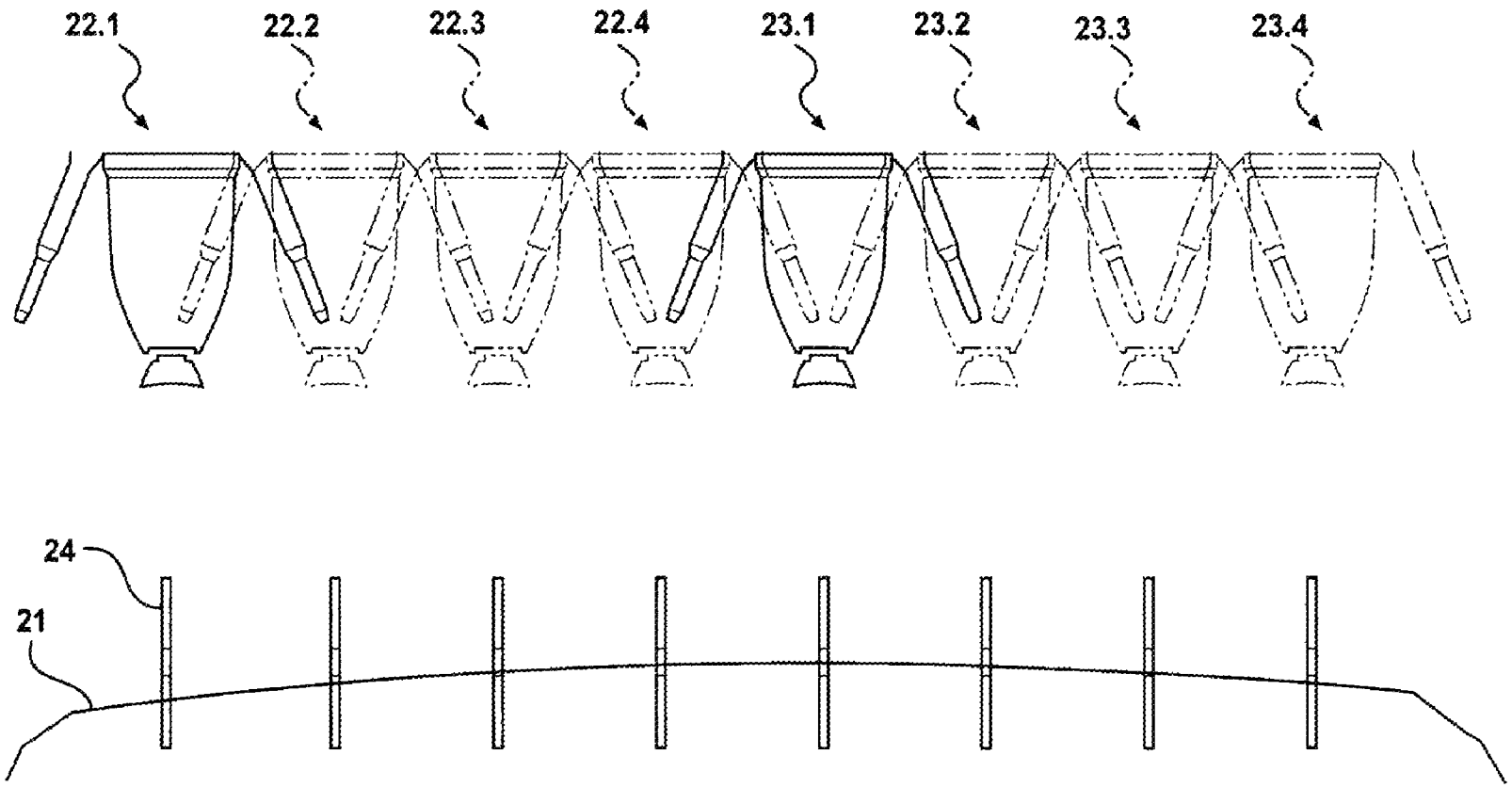
FIG. 10 is a schematic representation illustrating the painting of a curved vehicle roof.

FIG. 10 shows a scheme to clarify the painting of a horizontal curved vehicle roof 21, where four atomizer positions 22.1-22.4 or 23.1-23.4 are shown for each of two atomizers 11, 12.

From this illustration and the distance marks 24 shown it can be seen that the distance between the rotational atomizers 11, 12 and the vehicle roof 21 varies in the different working strokes because of the curvature of the vehicle roof 21. The distance between the rotational atomizers 11, 12 and the vehicle roof 21 is therefore continuously determined and taken into account in controlling the rotational atomizers 11, 12. The determination of the distance is made by evaluating the TCP (tool center point) specified by the path controls and the likewise specified and similarly known geometry of the vehicle roof 21. In controlling the rotational atomizers 11, 12, the shaping air pressure, for example, or the turbine speed, can adjusted accordingly in order to achieve a consistent paint build independently of the curvature of the vehicle roof 21.

Figure 11:
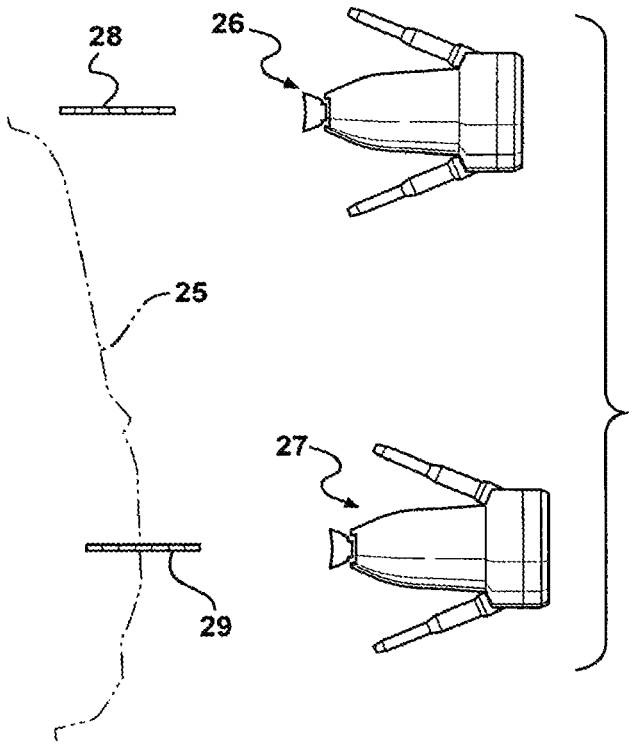
FIG. 11 is a schematic representation illustrating the painting of a curved vehicle side.

FIG. 11 shows a corresponding representation for the painting of a curved vehicle door 25 by two rotational atomizers 26, 27. It can be seen from two distance markings 28, 29 shown in the drawings that the distance for the two rotational atomizers 26, 27 is different. This different distance must be taken into consideration in this embodiment when controlling the rotational atomizers 26, 27.

Figure 12A:
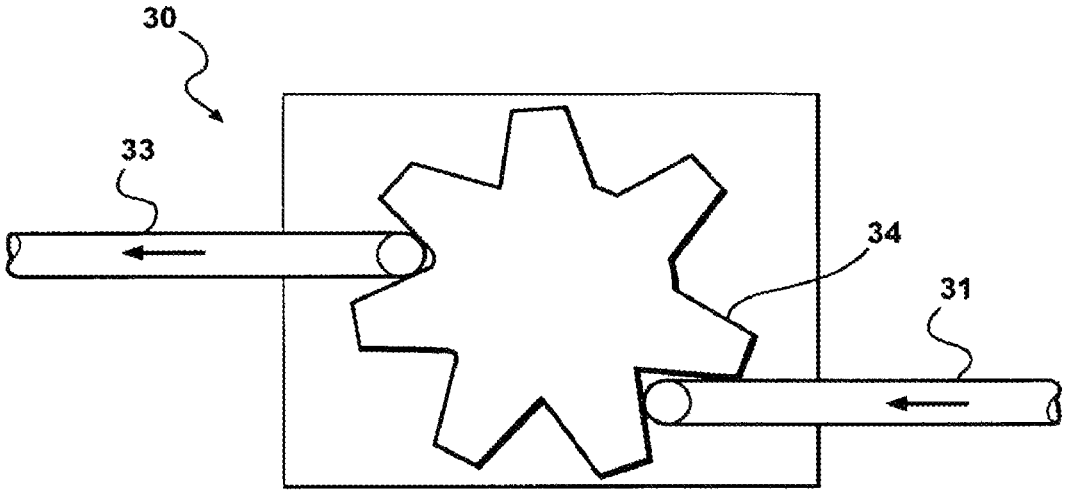
FIGS. 12*a* and 12*b* show a metering pump for an application robot in accordance with embodiments of the invention.
Figure 12B:
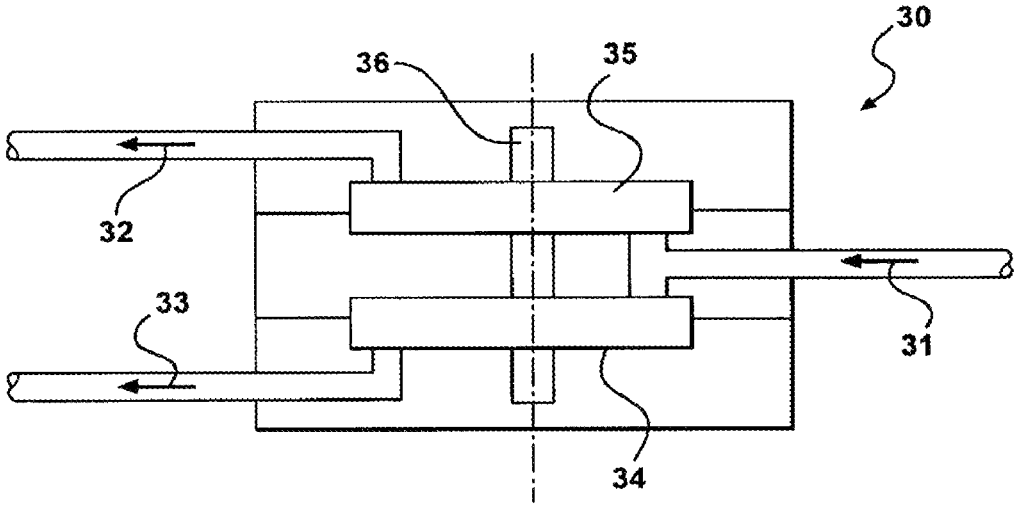

Finally, FIGS. 12*a* and 12*b* show a metering pump 30 for the painting robot 1 where the metering pump is preferably located in the robot arm 8 or in the robot arm 7. The metering pump 30 has a supply 31 through which paint is brought to the metering pump 30. The metering pump 30 further has two outlet lines 32, 33 that supply rotational atomizer 11 or rotational atomizer 12 with paint. The paint transfer is accomplished by two gears 34, 35 driven by a common shaft 36.

The invention is not restricted to the preferred embodiments described previously. A plurality of variants and modifications is possible, all of which make similar use of the inventive idea and therefore fall under its protection.

What is claimed is:

1. A method of operating an application robot having a spatially positionable end effector guiding a plurality of application devices connected to separate coating mediums, the method comprising:

positioning the spatially positionable end effector to coat the workpiece;

coating the workpiece with the coating mediums using spray from the application devices attached to the end effector; and changing a first type of the coating medium on a first one of the plural application devices while a second type of the coating medium is applied with a second one of the plural application devices, wherein changing the coating medium applied with the first one of the application devices includes purging the first one of the plural application devices.

2. The method according to claim 1, further comprising:

adjusting a spray width on at least one of the plural application devices.

3. The method according to claim 2 wherein adjusting a spray width further comprises adjusting the spray width such that spray from adjacent ones of the plural application devices overlap one another.

4. The method according to claim 1, further comprising:

determining a distance between respective ones of the plural application devices and the workpiece; and adjusting a spray width of at least on one of the plural application devices as a function of the distance determined so that sprays from adjacent ones of the plural application devices overlap one another.

5. The method according to claim 1, further comprising:

using a first type of coating medium in only one of the plural application devices; and using remaining ones of the plural application devices for all other possible types of the coating medium.

6. The method according to claim 1 wherein coating the workpiece with the coating medium further comprises using water-based paint in at least one of the plural application devices and using solvent-based paint in another of the plural application devices.

7. The method according to claim 1, further comprising:

driving the end effector to one edge of the workpiece to purge the plural application devices.

8. The method according to claim 1, further comprising:

guiding the end effector along a surface of the workpiece in a predetermined pass direction wherein the end effector is aligned essentially at a right angle to the pass direction or essentially parallel to the pass direction.

9. The method according to claim 1, further comprising:

aligning the end effector essentially at right angles to or parallel to a direction of transportation associated with the workpiece.

10. The method according to claim 1 wherein coating the workpiece with the coating medium further comprises guiding the end effector multiple times in parallel or antiparallel work strokes over the workpiece, wherein a distance between the individual work strokes is smaller than a width of the spray.

11. The method according to claim 10, further comprising:

advancing the end effector by a specified distance at right angles to the work strokes after a specified number of work strokes.

12. The method according to claim 1, further comprising:

determining a respective distance between each of the plural application devices and a surface of the workpiece; and modifying at least one operating parameter on respective ones of the plural application devices as a function of the respective distance determined for each of the plural application devices.

13. The method according to claim 12 wherein modifying the at least one operating parameter further comprises modifying at least one of a shaping air pressure, a turbine speed, a coating medium pressure, a high-voltage to charge the coating medium, a coating medium volume and a spray width.

14. The method according to claim 1, further comprising:

providing separately controllable purge lines for the application devices; and providing separately controllable coating medium lines for the application devices.

* * * * *